US009442427B2

(12) United States Patent
Ishida et al.

(10) Patent No.: US 9,442,427 B2
(45) Date of Patent: Sep. 13, 2016

(54) DEVELOPING DEVICE

(71) Applicant: CANON KABUSHIKI KAISHA, Tokyo (JP)

(72) Inventors: Yusuke Ishida, Toride (JP); Takanori Iida, Noda (JP); Hisashi Tsukijima, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/534,707

(22) Filed: Nov. 6, 2014

(65) Prior Publication Data

US 2015/0139696 A1 May 21, 2015

(30) Foreign Application Priority Data

Nov. 15, 2013 (JP) ..... 2013-236712

(51) Int. Cl.
*G03G 15/08* (2006.01)

(52) U.S. Cl.
CPC ..... *G03G 15/0893* (2013.01); *G03G 15/0877* (2013.01); *G03G 15/0887* (2013.01); *G03G 15/0891* (2013.01); *G03G 2215/0833* (2013.01)

(58) Field of Classification Search
CPC ..... G03G 15/0893; G03G 15/0865; G03G 15/0877; G03G 15/0887; G03G 15/0889; G03G 15/0891
See application file for complete search history.

(56) References Cited

U.S. PATENT DOCUMENTS 7,483,657 B2 1/2009 Ishida
7,536,120 B2 5/2009 Ishida
7,734,206 B2 6/2010 Ishida
8,867,967 B2 10/2014 Yamauchi et al.
2013/0177338 A1 7/2013 Iida
2015/0003876 A1 1/2015 Iida et al.

FOREIGN PATENT DOCUMENTS

JP 2010237328 A1 * 3/2009 ..... G03G 15/08
JP 2010-044335 A 2/2010
JP 2010-237329 A 10/2010
JP 2010-256701 A 11/2010
JP 2013-186306 A 9/2013

OTHER PUBLICATIONS

Hisashi Tsukijima et al., U.S. Appl. No. 14/548,773, filed Nov. 20, 2014.

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A developing device includes a developer carrying member and first and second chambers. A feeding member provided in the second chamber includes a normal feeding portion, a reverse feeding portion, and a discharging portion. An opposing portion in the second chamber opposes a peripheral surface of the reverse feeding portion and is formed so that a first region of an upper half of the reverse feeding portion is broader in clearance with the second chamber than a second region, and includes a projected portion for forming a predetermined clearance with the reverse feeding portion by being projected from a side surface of the second chamber in a horizontal direction. The projected portion is disposed higher than a rotation center of the reverse feeding portion and lower than a top of the reverse feeding portion and is more remote from the first chamber than a rotation center of the feeding member.

10 Claims, 8 Drawing Sheets

DEVELOPING DEVICE

FIELD OF THE INVENTION AND RELATED ART

The present invention relates to a developing device for developing an electrostatic image on an image bearing member into a toner image with a developer containing a toner and a carrier, and specifically relates to the developing device capable of discharging an excessive developer from an inside of a developing container to an outside of the developing container.

In an image forming apparatus in which the toner image is transferred onto a sheet and then is fixed by application of heat and pressure, the developing device for developing the electrostatic image on the image bearing member into the toner image with the developer containing the toner and the carrier has been widely used. In the developing device using the developer containing the toner and the carrier, the developer is circulated between a first chamber and a second chamber which communicated with each other through openings at end portions, and the electrostatic image on the image bearing member is developed with the developer while carrying the developer on a developer carrying member provided in the first chamber. Then, the excessive developer is discharged from the developing device in a downstream side of the second chamber while steadily supplying the carrier into the developing device, whereby an amount of the developer in the developing device is kept at a substantially constant level while suppressing progress of an average degree of deterioration of the carrier in the developer (Japanese Laid-Open Patent Application (JP-A) 2010-256701 and JP-A 2010-237329).

In the developing device in JP-A 2010-237329, a reverse screw (type) feeding member for pushing back the developer to a discharge port is provided in a region downstream of the opening, in the second chamber, through which the developer is to be delivered to the first chamber in which the developer carrying member disposed in the first chamber, and a developer discharging portion is provided downstream of the reverse screw feeding member in the second chamber. Further, at a position adjacent to the opening, a "damming member" is provided opposed to an outer peripheral surface of the reverse screw feeding member, so that excessive flow-in of the developer toward the discharging portion is limited.

The "damming member" shown in JP-A 2010-237329 is provided for preventing the developer, flowing back to the second chamber through the opening from the first chamber in which the developer carrying member, from flowing into the discharging portion. For this reason, in a constitution of JP-A 2010-237329, the "damming member" is disposed at a position of a side surface, of two side surfaces, of the second chamber only in a side toward the first chamber. For this reason, the developer directly flowing from the second chamber into the discharging portion through a space, in a side opposite from the side toward the first chamber, of spaces at the two side surfaces of the second chamber cannot be limited sufficiently.

Further, in a side where a screw blade is raised, a height of a developer surface is higher than in a side where the screw blade is lowered as seen in a rotational axis direction of the screw in the second chamber. For that reason, in the constitution of JP-A 2010-237329, depending on a rotational direction of the screw blade in the second chamber, in some cases, discharge of the developer to the discharging portion through a space in a side where the developer surface is high cannot be efficiently suppressed.

In this case, when a temperature and a humidity of the developing device, a shape of particles of the developer, a developer feeding speed and the like are changed, an amount of the developer discharged from the developing device becomes insufficient or excessive, so that there is a possibility that the developer amount in the developing device varies.

SUMMARY OF THE INVENTION

A principal object of the present invention is to provide a developing device capable of discharging an excessive developer from an outside of a circulation path in a second chamber while circulating the developer between a first chamber in which a developer carrying member is provided and the second chamber in which a feeding member is provided.

Anther object of the present invention is to provide a developing device capable of suppressing unintentional discharge of a developer from a gap between the feeding member and an inner wall surface of the second chamber in a side opposite to the first chamber as seen in a rotational axis direction of the feeding member provided in the second chamber.

According to an aspect of the present invention, there is provided a developing device comprising: a developer carrying member for carrying a developer containing a toner and a carrier; a first chamber in which the developer to be supplied to the developer carrying member is to be fed; a second chamber, communicating with end portions of the first chamber, for forming a circulation path for circulating the developer between the first chamber and the second chamber; a feeding member, provided rotatably in the second chamber, including a normal feeding portion for feeding the developer in the circulation path in a circulation direction and including a reverse feeding portion, provided rotatably downstream of the normal feeding portion with respect to a feeding direction of the normal feeding portion, for feeding the developer from an outside of the circulation path toward an inside of the circulation path; a discharging portion, provided upstream of the reverse feeding portion of the second chamber with respect to a feeding direction of the reverse feeding portion, for discharging an excessive developer in the second chamber; and a non-magnetic regulating portion, provided above a rotation center of the feeding member so as to oppose the reverse feeding portion with respect to a rotational axis direction of the feeding member, for regulating a gap between an inner wall of the second chamber and the reverse feeding portion so as to be narrowed, wherein the regulating portion is provided at least in a position opposite from the first chamber with respect to the rotation center of the feeding member as seen in the rotational axis direction of the feeding member.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be specifically described with reference to the drawings.

Embodiment 1

Image Forming Apparatus

Figure 1:
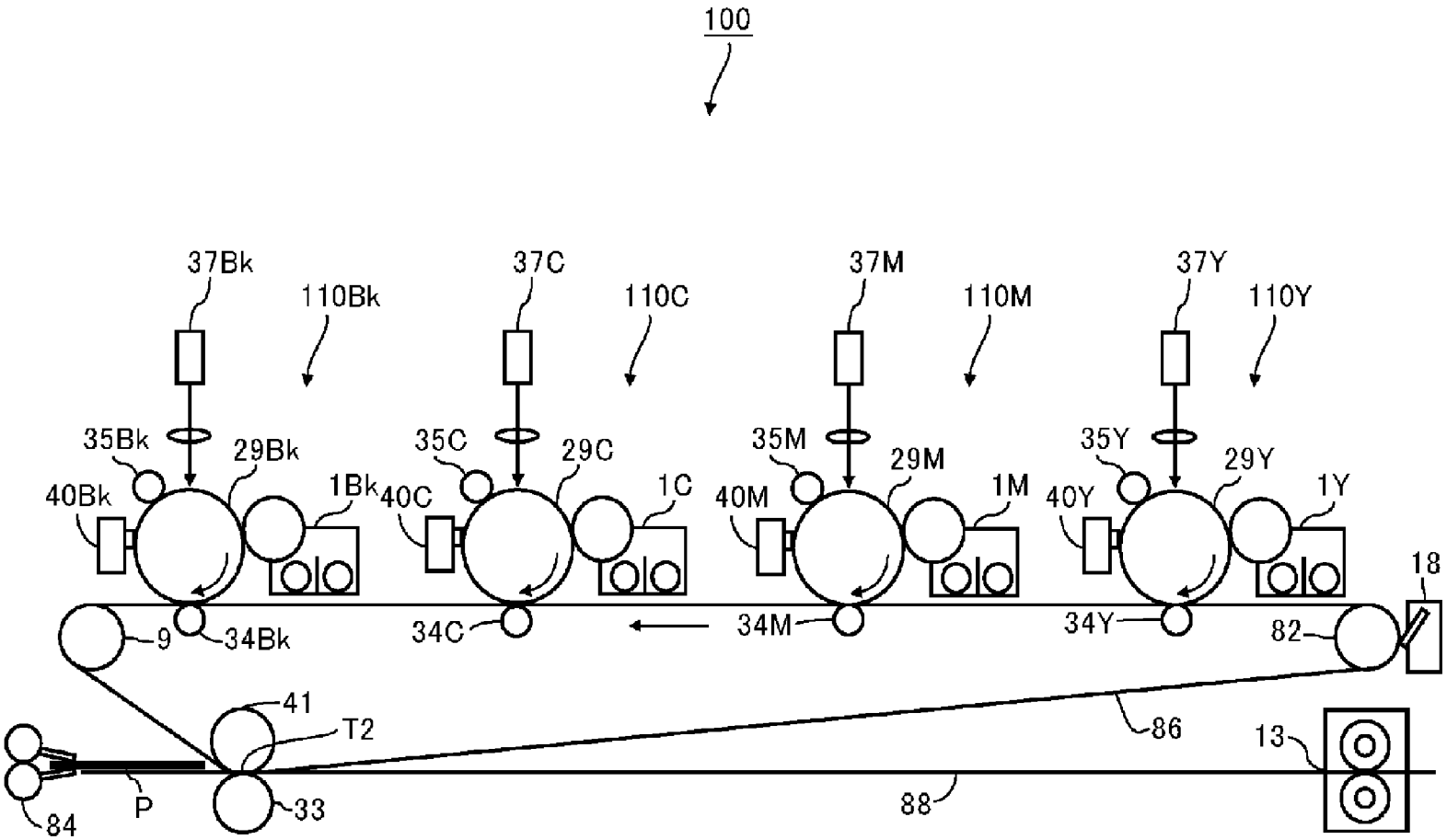
FIG. 1 is an illustration of a structure of an image forming apparatus.

FIG. 1 is an illustration of a structure of an image forming apparatus 100. As shown in FIG. 1, the image forming apparatus 100 is an intermediary transfer type full color printer of a tandem type in which image forming portions 11Y, 11M, 11C and 11Bk for yellow, magenta, cyan and black are arranged along an intermediary transfer belt 86.

At the image forming portion 11Y, a yellow toner image is formed on a photosensitive drum 29Y and then is transferred onto the intermediary transfer belt 86. At the image forming portion 11M, a magenta toner image is formed on a photosensitive drum 29M and then is transferred onto the intermediary transfer belt 86. At the image forming portions 11C and 11Bk, cyan and black toner images are formed on photosensitive drums 29C and 29Bk respectively, and then are transferred onto the intermediary transfer belt 86.

A sheet (recording material) P is fed to a secondary transfer portion T2 by a registration roller pair 84. In a process in which the sheet P passes through the secondary transfer portion T2, the sheet P on which the toner images are transferred is fed to a fixing device 130 in which the toner images are heated and pressed and thus are fixed on the sheet P. Thereafter, the sheet P is discharged to an outside of the image forming apparatus.

(Image Forming Portion)

The image forming portions 11Y, 11M, 11C and 11Bk have the substantially same constitution except that colors of toners used in developing devices 1Y, 1M, 1C and 1Bk, respectively, are yellow, magenta, cyan and black, respectively, are different from each other. In the following, constituent elements of the image forming portions will be collectively described by omitting suffixes Y, M, C and Bk for representing difference in colors of yellow, magenta, cyan and black.

The image forming portion 110 includes, at a periphery of the photosensitive drum 29, a charging roller 35, an exposure device 37, the developing device 1, a transfer roller 34 and a drum cleaning device 40. The photosensitive drum 29 is prepared by forming a photosensitive layer on an outer peripheral surface, and is rotated in an arrow direction in the figure. The charging roller 35 electrically charges a surface of the photosensitive drum 29 to a uniform potential. The exposure device (laser scanner) 37 scans the surface of the photosensitive drum 29 with a laser beam modulated on the basis of an image signal obtained by developing an image on a scanning line, so that an electrostatic image for the image is formed on the surface of the photosensitive drum 29. The developing device 1 develops the electrostatic image into the toner image with a developer containing a toner and a carrier.

The transfer roller 34 forms a toner image transfer portion between the photosensitive drum 29 and the intermediary transfer belt 86. By applying a transfer voltage to the transfer roller 34, the toner image carried on the photosensitive drum 29 is transferred onto the intermediary transfer belt 86. The drum cleaning device 40 collects a transfer residual toner deposited on the photosensitive drum 29 without being transferred onto the intermediary transfer belt 86.

(Developing Device)

Figure 2:
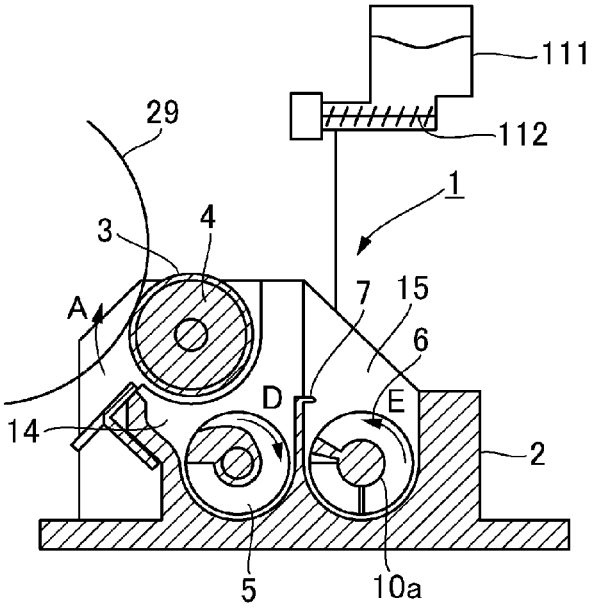
FIG. 2 is an illustration of a structure of a developing device in vertical cross-section in Embodiment 1.
Figure 3:
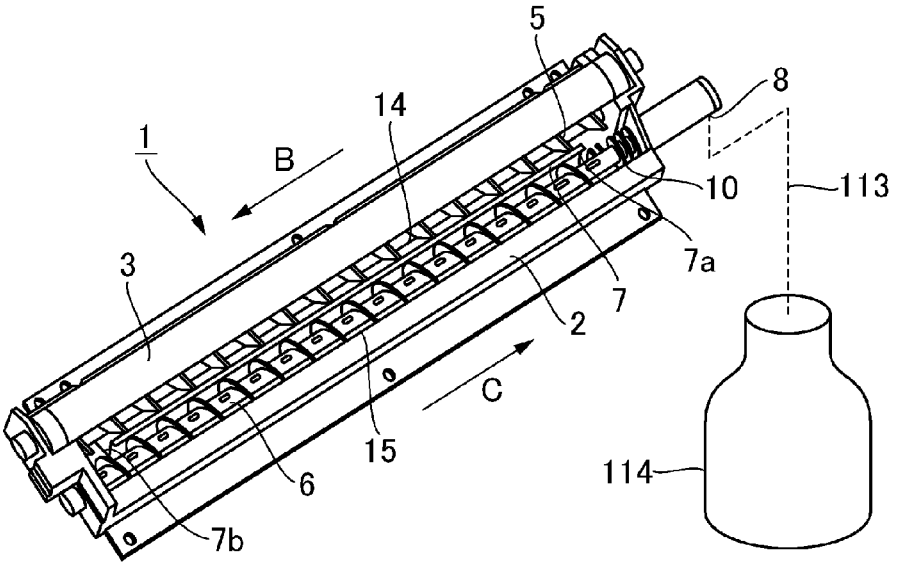
FIG. 3 is a perspective view of the developing device.
Figure 4:
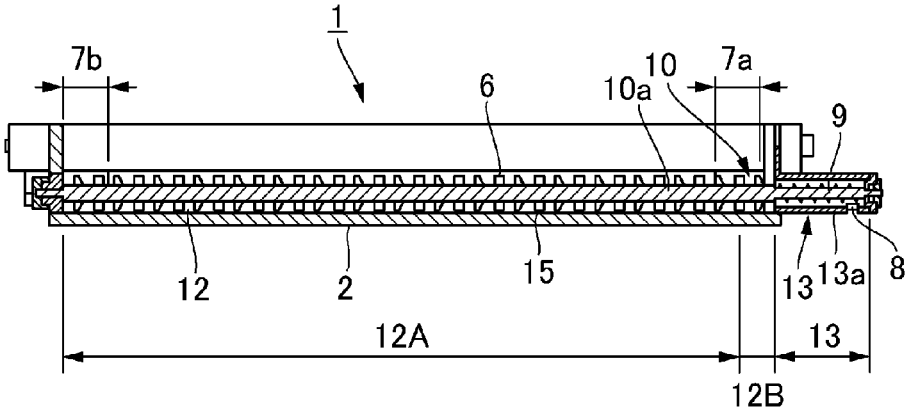
FIG. 4 is an illustration of a structure of the developing device in cross-section parallel to a shaft (axis).
Figure 5:
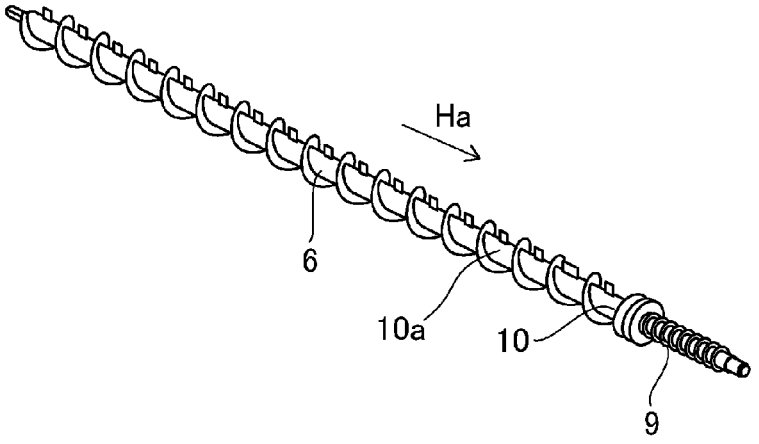
FIG. 5 is a perspective view of a feeding screw.
Figure 6:
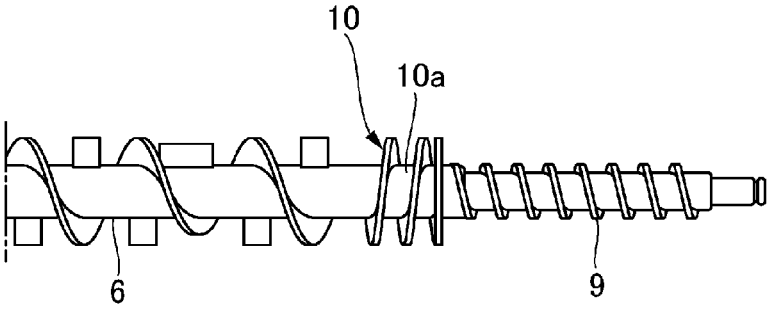
FIG. 6 is an illustration of an end portion structure of the feeding screw.

FIG. 2 is an illustration of a structure of a developing device in vertical cross-section in Embodiment 1. FIG. 3 is a perspective view of the developing device. FIG. 4 is an illustration of a structure of the developing device in cross-section parallel to a shaft (axis). FIG. 5 is a perspective view of a feeding screw. FIG. 6 is an illustration of an end portion structure of the feeding screw.

As shown in FIG. 2, the developing device 1 accommodates, in a developing container 2, the developer containing the toner (non-magnetic) and the carrier (magnetic). A mixing ratio between the toner and the carrier in the developer is about 1:9 in weight ratio. This ratio is not limited to the indicated numerical rate, but may be appropriately adjusted depending on a toner charge amount, a carrier particle size, a constitution of the image forming apparatus 100, and the like.

The developing container 2 is provided with an opening at a portion of a developing region opposing the photosensitive drum 29. A developing roller 3 is provided rotatably so as to be partly exposed through the opening. The developing roller 3 which is an example of a developer carrying member includes a magnet 4 provided therein in a non-rotational state. The developing roller 3 is formed of a non-magnetic aluminum material and is rotated in an arrow A direction during a developing operation. The developing roller 3 carries the developer, in the developing container 2 in a layer shape and then feeds the developer to the developing region, and thus supplies the toner to the photosensitive drum 29, so that the electrostatic image is developed into the toner image. The developer after the developing operation is collected in the developing container 2 with rotation of the developing roller 3.

As shown in FIG. 3, the developing container 2 is divided into a developing chamber 14 and a stirring chamber 15 by a partition wall 7. The partition wall 7 is provided between a feeding screw 5 and a feeding screw 6, and an opening 7*a* is provided in a rear side of the partition wall 7, and an opening 7*b* is provided in a front side of the partition wall 7. The stirring chamber 15 and the developing chamber 14 communicate with each other through the openings 7*a* and 7*b* provided in the partition wall 7, thus forming a circulation path of the developer. Between the feeding screws 5 and 6, the partition wall 7 is provided, and in order to smoothly circulate the developer, the openings 7*a* and 7*b* are provided in the rear side and the front side, respectively, of the partition wall 7.

In the developing chamber 14, the feeding screw 5 is provided. The feeding screw 5 stirs and mixes the developer in the developing chamber 14. In the stirring chamber 15, the feeding screw 6 is provided. The feeding screw 6 stirs and mixes the developer in the stirring chamber 15. The feeding screws 5 and 6 deliver the developer through the opening and 7*b* to feed the developer in arrow B and C directions, thus smoothly circulating the developer. By these feeding screws 5 and 6, the developer is circulated in the developing container 2 while being stirred and mixed.

A two-component developing system in which the development is made using the developer containing the toner and the carrier is, compared with other developing systems, excellent in stability of an image quality and durability of the developing device, but on the other hand, is liable to generate deterioration of the carrier with cumulative long-term use.

For that reason, the developing device 1 in Embodiment 1 includes an automatic developer exchange mechanism. The automatic developer exchange mechanism supplies a supply developer containing a carrier and a toner in an amount corresponding to a consumed amount of the toner by the developing operation of the photosensitive drum 1, and discharges an excessive developer (carrier) from the developing device 1 to accumulate the excessive developer in a collecting container. The automatic developer exchange mechanism discharges the excessive developer substantially simultaneously with the supply of the supply developer, and therefore it is possible to stabilize a characteristic of the developer as a whole without causing upsizing of the image forming apparatus and a sudden rise in cost. The automatic developer exchange mechanism eliminates the need for a manual operation such as developer exchange or developing device exchange, thus achieving an improvement in maintenance property and a reduction in running cost.

(Supply of Developer)

As shown in FIG. 2, a developer supplying portion 111 supplies, to the stirring chamber 15 of the developing device 1, the supply developer containing the toner and the carrier. The developer supplying portion 111 uses the supply developer containing the carrier in the toner at a certain proportion (weight ratio: about 10%). However, a carrier containing ratio is not limited thereto.

The developer supplying portion 111 rotates an unshown supply screw every image formation of one sheet, and supplies the supply developer, containing the toner in an amount corresponding to an amount of the toner consumed by the image formation, toward an upstream side of the feeding screw 6 of the developing container 2 with respect to a developer feeding direction. The developer supplying portion 111 supplies the supply developer so as to maintain a toner content (a weight ratio of the toner per unit weight of the developer) of the developer in the developing container 2 at a certain level. The toner in the amount corresponding to the amount of the toner consumed by the image formation is supplied, as the supply developer containing the carrier at a certain proportion, toward the upstream side of the feeding screw 6 of the developing container 2 with rotation of a supplying screw 112.

The toner is consumed by the image formation, but the carrier contained in the supply developer at the certain proportion is not consumed by the image formation, and therefore the carrier remains in the developing container 2 and is continuously circulated. For this reason, when the supply of the supply developer is repeated with the image formation, the amount of the developer in the developing device 1 gradually increases.

As shown in FIG. 4, the developer which became excessive in the developing container 2 is discharged to an outside of the developing device 1 through a developer discharge opening 8 of a discharge path connected to the stirring chamber 15 in a downstream side of the stirring chamber 15. The excessive developer in the stirring chamber 15 overflows and is discharged through the discharge path 13, so that the amount of the developer in the developing container 2 is maintained in a predetermined range. The toner in the amount corresponding to the amount of the consumed toner is supplied by the supply developer, and at the same time, the developer in which the supplied carrier becomes excessive is discharged. Replacement of the developer is automatically carried out gradually so as to maintain the developer in the developing container 2 at a certain level.

(Developer Discharging Portion)

As shown in FIG. 3, in the developing chamber 14 which is an example of a first chamber, the developer to be supplied to the developing roller 3 is fed. The stirring chamber 15 which is an example of a second chamber communicates with the developing chamber 14 at end portions to form a circulation path along which the developer is circulated between the stirring chamber 15 and the developing chamber 14.

As shown in FIG. 4, the feeding screw 6 which is an example of a feeding member is provided rotatably in the stirring chamber 15. A normal feeding portion of the feeding screw 6 feeds the developer, positioned in the circulation path, in a circulation direction in a normal feeding region 12A. A return screw 10 which is an example of a reverse feeding portion provided rotatably in a reverse feeding region 12B positioned downstream of the normal feeding portion with respect to the feeding direction, and feeds the developer, positioned outside the circulation path, toward an inside of the circulation path. A discharge path (discharge feeding region) 13, which is an example of a discharging portion, is provided upstream of the return screw 10 of the stirring chamber 15 with respect to a developer feeding direction of the return screw 10, and the excessive developer in the stirring chamber 15 is discharged along the discharge path 13.

As shown in FIG. 5 with reference to FIG. 6, the feeding screw 6, the return screw 10 and a discharging screw 9 include a common rotation shaft (axis) 10*a*. The rotation shaft 10*a* integrally rotates the feeding screw 6 having a feeding performance in a normal direction, the return screw 10 having a feeding performance in a reverse direction, and the discharging screw 9 having the feeding performance in the normal direction. As shown in FIG. 6, the discharging screw 9 is connected with the feeding screw 6 via the return screw 10 in the downstream side with respect to the feeding direction of the feeding screw.

As shown in FIG. 3, the return screw 10 returns the developer, to the opening 7*a*, moving toward the discharge path 13 by being pushed by the developer fed by the feeding screw 6. As a result, a flow of the developer in front of the opening 7*a* is weakened, and a height of the developer is increased, so that the developer flows into the developing chamber 14 through the opening 7*a*.

As shown in FIG. 4, the discharging screw 9 is positioned in the discharge path 13 connected to the reverse feeding region 12B of the stirring chamber 15. The developer discharge opening 8 is disposed at an end portion of the discharge path 13. An inner diameter of the discharge path 13 is somewhat smaller than an inner diameter of the reverse feeding region 12B of the stirring chamber 15, and a height of a bottom of the discharge path 13 is somewhat higher than a height of a bottom of the reverse feeding region 12B of the stirring chamber 15. The discharging screw 9 disposed in the discharge path 13 feeds the excessive developer, overflowing into the discharge path 13, toward the developer discharge opening 8, and discharges the excessive developer through the developer discharge opening 8.

When the developer amount in the developing container 2 and thus a developer height at a position of the return screw 10 exceeds a predetermined level, the developer rides over the return screw 10 and flows into the discharge path 13. The developer overflowing into the discharge path 13 is fed to the discharging screw 9 to be fed to the developer discharge opening 8. As shown in FIG. 3, the developer discharged through the developer discharge opening 8 pass through a feeding pipe path 113 and then is collected and accumulated in a collecting container 114.

(Characteristic Portion of Embodiment 1)

Figure 7:
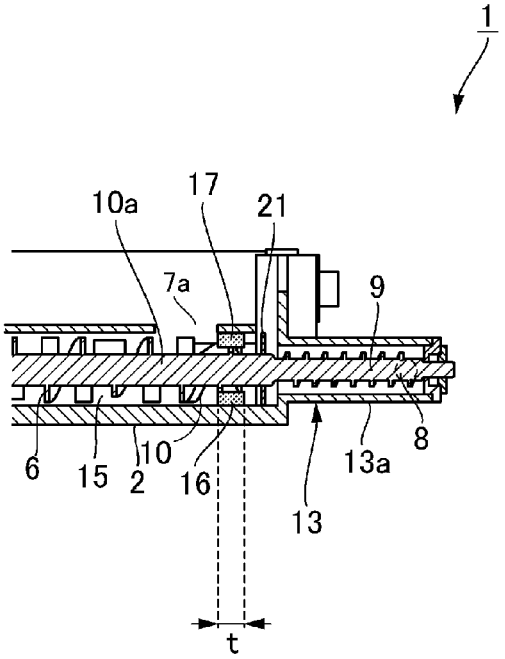
FIG. 7 is a partially horizontal sectional view of the developing device in Embodiment 1.
Figure 8:
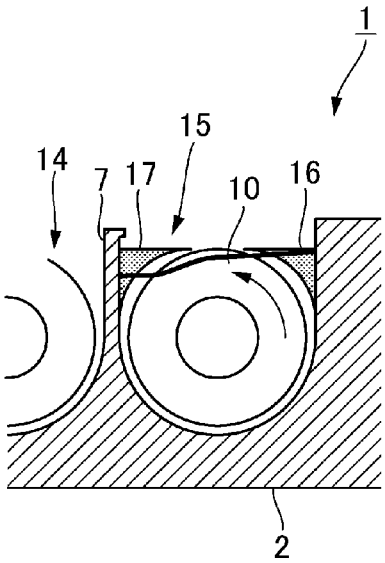
FIG. 8 is a vertical sectional view of a stirring chamber as seen from an upstream side.
Figure 9:
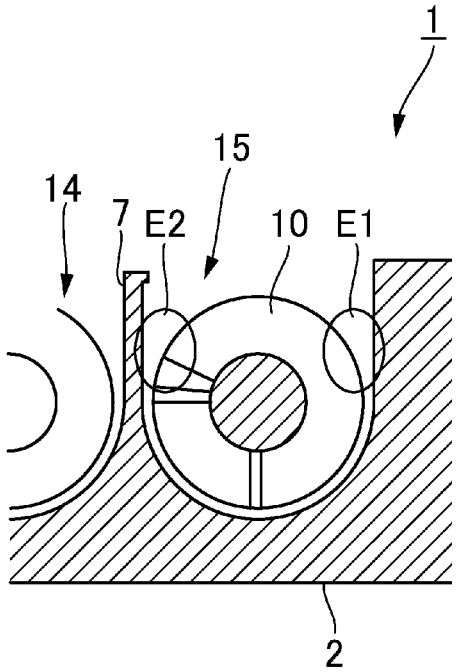
FIG. 9 is an illustration of a place where a developer is easily discharged.
Figure 10:
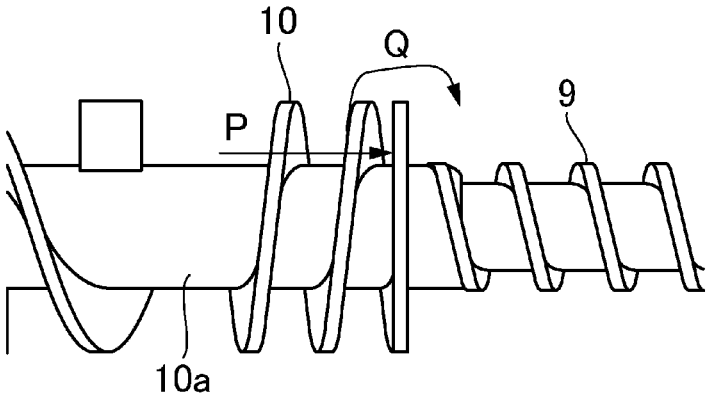
FIG. 10 is an illustration of the reason why the developer is easily discharged.

FIG. 7 is a partially horizontal sectional view of the developing device in Embodiment 1. FIG. 8 is a vertical sectional view of a stirring chamber as seen from an upstream side. FIG. 9 is an illustration of a place where a developer is easily discharged. FIG. 10 is an illustration of the reason why the developer is easily discharged.

As shown in FIG. 8, a gap in view of a dimension tolerance of an outer diameter of the return screw 10 and an inner diameter of the stirring chamber 15 is provided between the return screw 10 and an inner wall of the stirring chamber 15, so that the return screw 10 is prevented from interfering with the inner wall of the stirring chamber 15. When the return screw 10 interferes with the inner wall of the stirring chamber 15, at an interfering portion, agglomeration of the developer generates and an operation noise becomes large in some cases.

However, as shown in FIG. 9, when the gap exists between the return screw 10 and the inner wall of the stirring chamber 15, leakage of the excessive developer is liable to gape through regions E1 and E2 each shown by an ellipse. The leakage of the excessive developer through the regions E1 and E2 promotes the developer discharge with drive of the developing device 1. When the leakage of the excessive developer through the regions E1 and E2 continues and the amount of the developer circulating between the developing chamber 14 and the stirring chamber 15 is below a normal range, the developer amount in the developing chamber 14 becomes insufficient and thus the developing roller 3 is not sufficiently coated with the developer, so that density non-uniformity generates in an output image in some cases.

As shown in FIG. 9, a developer leakage phenomenon that the developer rides over the return screw 10 is liable to generate in an upper-half region of the return screw 10 in vertical cross-section of a shaft (axis) of the return screw 10. In a lower-half region of the return screw 10 in vertical cross-section of the shaft of the return screw 10, the developer loses flowability by its own weight and pressure, and therefore little developer leakage is generated.

As shown in FIG. 10, in a region close to an outward inner wall of the return screw 10, as shown by an arrow P, the developer fed toward a downstream side in the stirring chamber 15 is liable to ride over the return screw 10 by momentum thereof to flow out. On the other hand, in a region close to the return screw 10 and an inside region of the return screw 10, as shown by an arrow Q, the developer is prevented from moving by a developer feeding force toward an upstream side of the return screw 10, so that the developer does not readily ride over the return screw 10 and thus does not readily flow out.

Therefore, in this embodiment, on the inner wall of the stirring chamber 15, damming members 16 and 17 are provided in the neighborhood of the return screw 10. The damming member 17 was provided on the inner wall (partition wall 7) in a side close to the developing chamber 14 in the upper-half region of the return screw 10 in the vertical cross-section of the shaft of the return screw 10 and the damming member 16 was provided on the inner wall in a side remote from the developing chamber 14 in the upper-half region. In the upper-half region of the return screw 10 in the vertical cross-sectional of the shaft of the return screw 10, the developer likely to flow out through the gap between the return screw 10 and the inner wall of the stirring chamber 15 was returned to the circulation of the developer in the developing container 2 by being brought into collision with the damming members 16 and 17.

(Size of Damming Member)

The damming members 16 and 17 are disposed on an outer peripheral surface of the return screw 10 so as to oppose each other, and a gap (spacing) therebetween is designed so as to be 0.6 mm. With a smaller gap between the damming members 16 and 17, a larger degree of the developer leakage is suppressed, but there is a need to ensure the gap to the extent such that the rotating return screw 10 does not interfere with the damming members 16 and 17. The gap return the damming members 16 and 17 is a value designed in view of a dimension tolerance of the return screw 10 and the damming members 16 and 17.

As shown in FIG. 7, a width t of the damming members 16 and 17 with respect to a screw shaft (axis) direction may preferably be a pitch width (3.0 mm in this embodiment) or more of the return screw 10. In the case where the width of the damming members 16 and 17 is less than the pitch width of the return screw 10, in some cases, the developer leaks out through between the rotation shaft 10*a* of the return screw 10 and each of the damming members 16 and 17. In this embodiment, the width t of the damming members 16 and 17 was 3.5 mm. However, even when the width t of the damming members 16 and 17 is less than the pitch width of the return screw 10, a large effect is obtained when compared with the case where there is no damming member as shown in FIG. 5. For this reason, it is not necessarily essential that in the constitution of the present invention, the width of the damming members 16 and 17 is the screw pitch width or more.

The damming members 16 and 17 are resin-molded integrally with the developing container 2. As shown in FIG. 4, the rotation shaft 10*a* on which the feeding screw 6, the return screw 10 and the discharging screw 9 are formed is inserted into the stirring chamber 15 along a rotational axis direction from a side opposite from the discharge path 13. For that reason, the damming members 16 and 17 do not constitute an obstacle to assembling of the rotation shaft 10*a*.

(Position of Damming Member)

As shown in FIG. 7, the damming members 16 and 17 are shifted to and disposed at the upstream side of the return screw 10. The damming members 16 and 17 may preferably be disposed in an upstreammost side in a range opposing the return screw 10, i.e., at a downstreammost position of the feeding direction of the return screw 10. As shown in FIG. 8, with a lower surface of the developer in contact with the return screw 10, the gap between the return screw 10 and the inner wall of the stirring chamber 15 becomes smaller. For this reason, as the damming members 16 and 17 are shifted toward the upstream side (the downstream side with respect to the feeding direction) of the return screw 10 in a larger amount, an effect of returning the developer, like to leak out from the developing container 2, to the circulation path in the developing container 2 becomes larger. However, even when the damming members 16 and 17 are shifted to the downstream side of the return screw 10, a large effect is obtained when compared with the case where these is no damming member as shown in FIG. 9. For this reason, it is not necessarily essential that in the constitution of the present invention, the width of the damming members 16 and 17 is shifted to the upstream side of the return screw 10.

In this embodiment, a side where a screw blade raises with rotation of the feeding screw 6 when the feeding screw 6 is viewed from the rotational axis direction of the feeding screw 6 is a side opposed from the developing chamber 14 with respect to a rotation center of the feeding screw 6. For this reason, during an operation, as shown in FIG. 8 by a solid line, in this embodiment, the developer surface is formed, and in the case where the developer amount in the stirring chamber 15 becomes excessive, the developer rides over the damming member 16 and flows into the downstream side, so that the developer is discharged from the developing container 2. As shown in FIG. 8, in this embodiment, the damming members 16 and 17 are not formed at a top portion of the return screw 10, and therefore in the case where the developer amount in the developing container 2 becomes excessive, necessary discharge of the developer is not prevented by the damming members 16 and 17.

As a Comparison Example, the constitution of the developing device shown in JP-A 2010-237329 will be compared with the constitution of the developing device in Embodiment 1.

Referring to FIG. 3, in the Comparison Example, on the inner wall (partition wall 7) provided with the opening (7*a*), the damming member (17) is provided. Alternatively, in the Comparison Example, the damming member (17) is provided on the inner wall (partition wall 7) in a side where the developer (surface) is lowered with the rotation of the feeding screw 6. Further, the damming member (17) has an effect of damming up the developer flowing back from the upstream side of the feeding screw (5) toward the downstream side of the feeding screw (6) through the opening (7*a*).

However, the damming member (17) cannot dam up the developer leaking out toward the downstream side of the stirring chamber 15 through a gap between the return screw 10 and the inner wall in a side opposite from the side where the opening 7*a* is provided. Alternatively, the damming member (17) cannot dam up the developer leaking out toward the downstream side of the stirring chamber 15 through the gap between the return screw 10 and the inner wall in a side where the developer (surface) is raised with the rotation of the feeding screw 6. This is because in the Comparison Example, the damming member 16 shown in FIGS. 7 and 8 is not provided.

As shown in FIG. 8, in the side where the developer is raised with the rotation of the feeding screw 6, the developer surface becomes higher than in a side where the developer is lowered with the rotation of the feeding screw 6. For this reason, in the side where the developer is raised with the rotation of the feeding screw 6, a cross-sectional area of a flow of the developer which rides over the return screw 10 and then flows toward the downstream side of the stirring chamber 15 becomes larger than in the side where the developer is lowered with the rotation of the feeding screw 6.

As shown in FIG. 3, in the inner wall side where the opening 7*a* is provided, the developer flows out into the developing chamber 14, and therefore, the surface of the developer is lower than in the inner wall side where the opening 7*a* is not formed (i.e., when there no escape route). For this reason, in the inner wall side where the opening 7*a* is provided, the cross-sectional area of the flow of the developer which rides over the return screw 10 and flows toward the downstream side of the stirring chamber 15 is smaller than in the inner wall side where the opening 7*a* is not provided.

As shown in FIG. 9, the developer surface is higher in a region E1 remote from the partition wall 7 than in a region E2 close to the partition wall 7, and therefore a leaking amount of the developer through the region E1 is larger than through the region E2. When the lowest point of the return screw 10 is taken as a starting point, in the upstream region E1 with respect to the rotational direction of the return screw 10, the developer surface is higher than in the downstream region E2 with respect to the rotational direction of the return screw 10, and therefore the leaking amount of the developer through the region E1 is larger than through the region E2.

Accordingly, the flow of the developer which rides over the return screw 10 and flows toward the downstream side of the stirring chamber 15 is largely localized toward the damming member 16 side, and therefore an effect of limiting the developer to be discharged from the stirring chamber is considerably larger by the damming member 16 than by the damming member 17. The constitution of the developing device in the Comparison Example, in which only the damming member (17) is provided, is not efficient in suppressing the amount of the developer leaking out toward the downstream side of the stirring chamber 15 through the gap between the return screw 10 and the inner wall of the stirring chamber 15. In the developing device of the Comparison Example in which the damming member 16 is not provided, particularly in the constitution in which the developer surface is higher in the region E1 side, the suppression of the developer amount is not sufficient.

In Embodiment 1, the reason why the side where the screw blade is raised with the rotation of the feeding screw 6 is the side opposite from the developing chamber 14 is as follows. In order to facilitate the supply of the developer toward the developing roller 3 in the developing chamber 14, the feeding screw 5 is rotated clockwisely. Further, the feeding screws 5 and 6 establish drive transmission by direct engagement of gears at shaft end portions thereof, and therefore the feeding screws 5 and 6 are rotated in reverse directions from each other. For this reason, the rotational directions are as in Embodiment 1.

Accordingly, even in a constitution, opposite to the constitution in Embodiment 1, in which the developer surface is higher in the region E2 shown in FIG. 9 than in the region E1, the present invention can be carried out. That is, such a constitution is the case where when the feeding screw 6 is seen in the rotational axis direction thereof, the side where the screw blade is raised with the rotation of the feeding screw 6 is the side close to the developing chamber 14 with respect to the rotation center of the feeding screw 6.

In the constitution of Embodiment 1, the damming members 16 and 17 which are an example of a regulating portion are provided above the rotation center of the feeding screw 6 so as to oppose the return screw 10 at positions at least in the side opposite from the side toward (close to) the developing chamber 14 with respect to the rotation center of the feeding screw 6. The damming member 16 regulates the gap between the inner wall of the stirring chamber 15 and the return screw 10 so as to be narrowed. The damming member 17 regulates the gap between the stirring chamber 15 and the return screw 10 in the side toward the developing chamber 14, which is an example of the first chamber, with respect to the rotation center of the feeding screw 6 so as to be partly narrowed. The damming member 16 is provided in the upstream side of the return screw 10 with respect to the rotational axis direction of the feeding screw 6.

As described above, according to Embodiment 1, the damming members 16 and 7 are provided, and therefore the effect of suppressing the amount of the developer discharged by flowing out toward the downstream side of the stirring chamber 15 is sufficient. Accordingly, the developer amount in the developing container 2 can be properly maintained, so that stable image formation can be effected for a long time. The damming member 16 is provided, and therefore the leakage of the developer through the gap between the return screw 10 and the inner wall of the stirring chamber 15 is suppressed, so that it is possible to suppress a fluctuation in discharge of the developer through the region E1 in FIG. 9. As a result of the suppression of the leakage of the excessive developer, the developer amount in the developing container 2 is stabilized.

Embodiment 2

Figure 11:
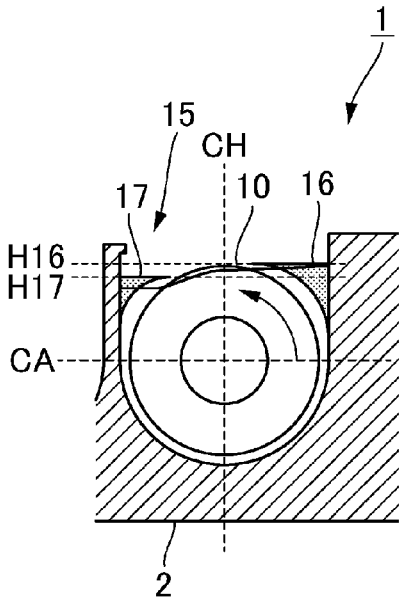
FIG. 11 is a vertical sectional view of a stirring chamber in a developing device in Embodiment 2 as seen from an upstream side.

FIG. 11 is a vertical sectional view of a stirring chamber of a developing device in Embodiment 2 as seen from an upstream side. The developing device in this embodiment is constituted similarly as in Embodiment 1 except that a size of the damming member provided on the inner wall in the side where the opening is provided is small. Accordingly, in FIG. 11, constituent elements common to Embodiments 1 and 2 are represented by the reference numerals or symbols common to FIG. 11 and FIGS. 7-10, and will be omitted from redundant description.

As shown in FIG. 8, the developer surface is high in the damming member 16 side, and therefore in the case where both heights of the damming members 16 and 17 are made higher than those in FIG. 8, the developer which becomes excessive in the developing container 2 cannot be discharged in the damming member 17 side. On the other hand, in the case where both of the heights of the damming members 16 and 17 are made lower than those in FIG. 8, the developer in the developing container 2 is excessively discharged in the damming member 16 side.

Therefore, as shown in FIG. 11, in this embodiment, correspondingly to an inclination of the developer surface, the height of the damming member 16 is higher than the height of the damming member 17. The damming members 16 and 17 were disposed at different heights in two regions (E1 and E2 in FIG. 9) which oppose each other at an upper-half portion of the return screw 10. The height H16 of the damming member 16 disposed in the region E1 was made higher than the height H17 of the damming member 17 disposed in the region E2. In the figure, the return screw 10 has a center CH with respect to the horizontal direction and a Comparison Example CA with respect to the height direction.

According to Embodiment 2, the damming members 16 and 17 are provided, and therefore the developer which leaks out toward the downstream side of the stirring chamber 15 through the gap between an upper-half peripheral surface of the return screw 10 and the inner wall of the stirring chamber 15 and then is excessively discharged is decreased in amount so that the developer amount in the developing container 2 is stabilized.

According to Embodiment 2, the heights of the damming members 16 and 17 are made different from each other, and therefore when the developer in the developing container 2 becomes excessive, the excessive developer overflows both of the damming members 16 and 17 at the same time and then is quickly discharged to the downstream side. For this reason, the developer in the developing container 2 does not readily become excessive. According to Embodiment 2, the height of the damming member 16 in the region E1 where the developer is liable to leak out is made higher than the height of the damming member 17 in the region E2 where the developer does not readily leak out, and therefore the leakage of the excessive developer can be suppressed effectively.

According to the constitution of Embodiment 2, the heights of the damming members 16 and 17 are higher in the side where the screw blade is raised with the rotation of the feeding screw 6 as seen in the rotational axis direction of the feeding screw 6 than in the side where the screw blade is lowered with the rotation of the feeding screw 6. For this reason, the heights of the damming members 16 and 17 are settable correspondingly to the developer surface heights in the sides where the damming members 16 and 17 are provided. For this reason, when compared with the case where the damming members 16 and 17 have the same height as in Embodiment 1, it is possible to suppress inconveniences such that the discharge of the developer is excessively suppressed in the damming member 17 side and that the discharge of the developer cannot be suppressed sufficiently in the damming member 16 side.

Embodiment 3

Figure 12:
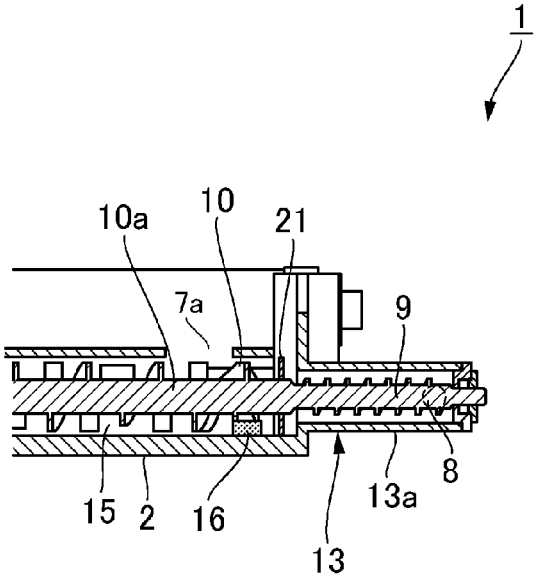
FIG. 12 is a partially horizontal sectional view of a developing device in Embodiment 3.

FIG. 12 is a partial horizontal sectional view of a developing device in Embodiment 3.

Figure 13:
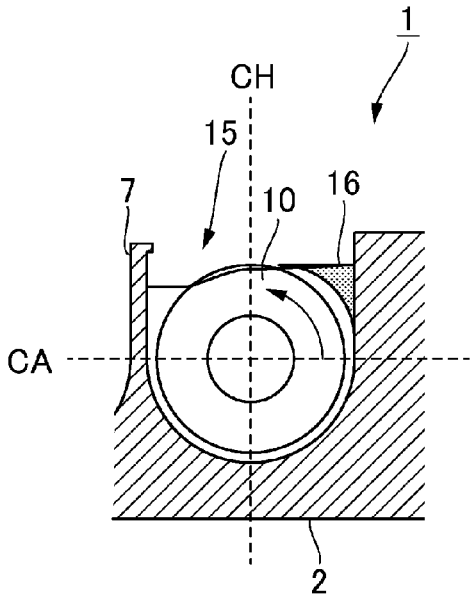
FIG. 13 is a vertical sectional view of a stirring chamber as seen from an upstream side.

FIG. 13 is a vertical sectional view of a stirring chamber as seen from an upstream side. The developing device in this embodiment is constituted similarly as in Embodiment 1 except that no damming member is provided on the inner wall in the side where the opening is provided. Accordingly, in FIG. 11, constituent elements common to Embodiments 1 and 2 are represented by the reference numerals or symbols common to FIGS. 11 and 12 and FIGS. 7-10, and will be omitted from redundant description.

As described above with reference to FIG. 9, during the operation of the developing device 1, in the region E1, the developer surface is higher than in the region E2, so that the leakage out of the developer through the region E1 is larger in amount than the leakage out of the developer through the region E2.

As shown in FIG. 13, in Embodiment 3, the damming member 16 was disposed only in the region E1, but no damming member was disposed in the region E2. As a result, it was substantiated that even only by the damming member 16, it is possible to effectively suppress the developer leakage through the gap between the return screw 10 and the inner wall of the stirring chamber 15. The developer likely to pass through the return screw 10 through the region E1 was brought into collision with the damming member 16 and then was returned again into the developing container 2, so that the developer excessively discharged to the outside of the developing container 2 was decreased and thus the developer amount in the developing container 2 was stabilized. In the figure, the return screw 10 has a center CH with respect to the horizontal direction and a center CA with respect to the height direction.

As described in Embodiment 2, in the case where the leakage out of the developer through the region E2 is completely blocked by disposing the damming member 17, when the developer amount in the developing container 2 becomes large, a necessary discharge amount cannot be ensured in some cases.

For this reason, the damming member is not disposed in the region E2 where the leakage amount is relatively small, so that in the case where the developer amount in the developing container 2 becomes large, the necessary discharge amount was able to be ensured in the region E2. As a result, the discharge of the developer through the region E2 became smooth, so that the leakage of the developer due to the increase in developer amount, an overload of the driving system, and the like did not readily occur.

Embodiment 4

Figure 14:
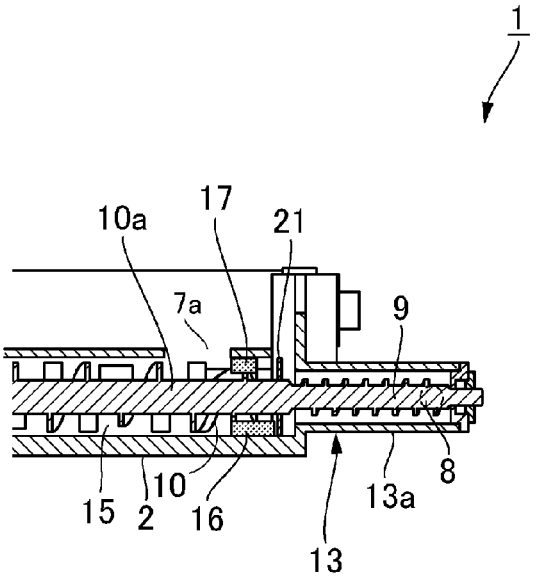
FIG. 14 is a partially horizontal sectional view of a developing device in Embodiment 4.

FIG. 14 is a partial horizontal sectional view of a developing device in Embodiment 4.

Figure 15:
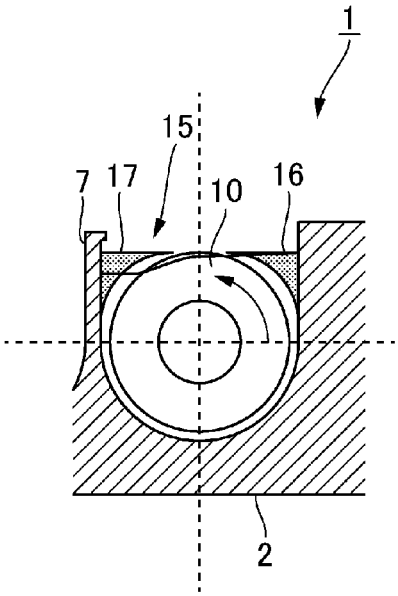
FIG. 15 is a vertical sectional view of a stirring chamber as seen from an upstream side.

FIG. 15 is a vertical sectional view of a stirring chamber as seen from an upstream side.

The developing device in this embodiment is constituted similarly as in Embodiment 1 except that a damming member provided on an inner wall in a side remote from an opening has a length, with respect to a rotational axis direction, longer than a damming member provided on the inner wall in a side close to the opening. Accordingly, in FIG. 11, constituent elements common to Embodiments 1 and 2 are represented by the reference numerals or symbols common to FIGS. 14 and 15 and FIGS. 7-10, and will be omitted from redundant description.

As shown in FIG. 9 with reference to FIG. 8, the developer surface of higher in the upstream region E1 with respect to the rotational direction of the return screw 10 than in the downstream region E2 with respect to the rotational direction of the return screw 10, and therefore the developer leakage through the region E1 is larger in amount than the developer leakage through the region E2. Therefore, as shown in FIG. 14, in Embodiment 4, the damming member 16 disposed in the region E1 in the upstream side of the rotational direction was formed in a shape longer, along a rotational axis, than a shape of the damming member 17 disposed in the region E2 in the downstream side of the rotational direction. As shown in FIG. 14, heights of the damming members 16 and 17 were made equal to each other.

In Embodiment 4, with respect to the direction along the rotational axis direction of the return screw 10, the length of the damming member 16 is longer than the length of the damming member 17. By making the damming member 16 longer than the damming member 17, it is possible to effectively suppress the flowing out of the developer in the region E1 side, in FIG. 9, where the developer surface is higher than in the region E2.

As a result, as described in Embodiment 2, when the developer in the developing container 2 becomes excessive, the excessive developer overflows both of the damming members 16 and 17 at the same time and then is quickly discharged to the downstream side. For this reason, the developer in the developing container 2 does not readily become excessive.

According to the constitution of Embodiment 2, the lengths of the damming members 16 and 17 with respect to the rotational axis direction of the feeding screw 6 are longer in the side where the screw blade is raised with the rotation of the feeding screw 6 as seen in the rotational axis direction of the feeding screw 6 than in the side where the screw blade is lowered with the rotation of the feeding screw 6. For this reason, the lengths of the damming members 16 and 17 are settable correspondingly to the developer surface heights in the sides where the damming members 16 and 17 are provided. For this reason, when compared with the case where the damming members 16 and 17 have the same length as in Embodiment 1, it is possible to suppress inconveniences such that the discharge of the developer is excessively suppressed in the damming member 17 side and that the discharge of the developer cannot be suppressed sufficiently in the damming member 16 side.

Further, the length of the damming member 17 with respect to the rotational axis direction of the return screw 10 was made shorter than that in Embodiment 1, and therefore an area, of the damming member 17, overlapping with an area of the opening 7*a* shown in FIG. 4 became small. For this reason, the flow of the developer flowing into the developer chamber 15 became smooth.

Embodiment 5

Figure 16:
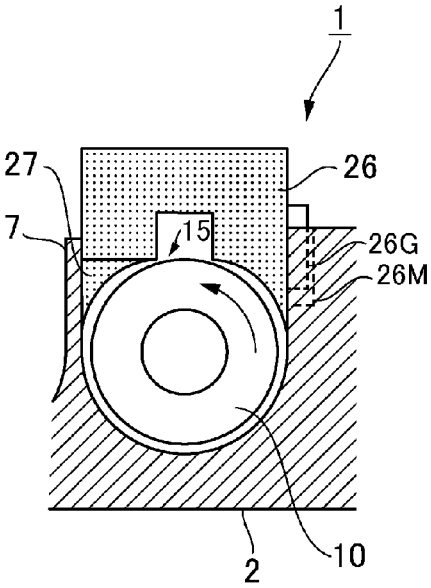
FIG. 16 is an illustration of a developing device in Embodiment 5.

FIG. 16 is an illustration of a developing device in Embodiment 5.

In Embodiment 1, as described above, as a part of the resin molded developing container 2, the damming members 16 and 17 were resin-molded in advance. In this embodiment, the developing device 1 is assembled by mounting damming members 26 and 27, as separate members, on the developing container 2. Other constitutions and functions are similar to those in Embodiment 1, and therefore, in FIG. 16, constituent elements common to Embodiments 1 and 2 are represented by the reference numerals or symbols common to FIG. 16 and FIGS. 7-10, and will be omitted from redundant description.

As shown in FIG. 16, at a portion where a damming member 26 of the developing container 2 is mounted, a dovetail groove 26M is formed with respect to a vertical direction. The damming member 26 is provided with a dovetail mold 26G adapted to the dovetail groove 26M. The damming member 26 is, after the return screw 10 is assembled with the stirring chamber 15, inserted from above thus is assembled with the stirring chamber 15.

The damming member 26 was formed in a portal shape such that the damming member 26 covers an upper-half space of the return screw 10 while leaving a discharging space for the excessive developer.

OTHER EMBODIMENTS

The present invention can be carried out also in other embodiments in which a part or all of constituent elements of the above-described embodiments are replaced with alternative constituent elements thereof.

Accordingly, the present invention can also be carried out not only in the developing device of a horizontal stirring type in which the developing chamber and the stirring chamber are horizontally disposed but also in a developing device of a vertical stirring type in which the developing chamber and the stirring chamber are disposed at different heights.

The image forming apparatus can be carried out irrespective of types such as one drum type/tandem type, one-component developer/two-component developer, and intermediary transfer type/recording material feeding member type. The image forming apparatus can be carried out irrespective of the number of the image bearing members, the charging method for the image bearing member, an electrostatic image forming system, the development type, the transfer type, the fixing type, and the like.

In the above-described embodiments, only a principal portion relating to toner image formation and transfer is described, but the present invention can be carried out in image forming apparatuses having various uses such as printers, various printing machines, copying machines, facsimile machines, and multi-function machines, by adding necessary equipment, devices and casing structures.

In the developing device of the present invention, the developer is circulated between the first chamber in which the developer carrying member is disposed and the second chamber in which the feeding member is disposed, and the excessive developer is dischargeable from the outside of the circulation path in the second chamber. Further, it is possible to suppress, by the regulating portion, unintentional flowing-out of the developer from the gap between the feeding member and the inner wall of the second chamber in the side opposite from the first chamber as seen in the rotational axis direction of the feeding member provided in the second chamber.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 236712/2013 filed Nov. 15, 2013, which is hereby incorporated by reference.

What is claimed is:

1. A developing device comprising:

a developer carrying member for carrying a developer containing a toner and a carrier;

a first chamber in which the developer to be supplied to said developer carrying member is to be fed;

a second chamber, communicating with end portions of said first chamber, for forming a circulation path for circulating the developer between said first chamber and said second chamber;

a feeding member, provided rotatably in said second chamber, including a normal feeding portion for feeding the developer in the circulation path from one end portion to the other end portion of said second-chamber, and a reverse feeding portion, provided rotatably downstream of the normal feeding portion with respect to a feeding direction of the normal feeding portion, for feeding the developer from an outside of the circulation path toward an inside of the circulation path;

a discharging portion, provided upstream of the reverse feeding portion of said second chamber with respect to a feeding direction of the reverse feeding portion, for discharging an excessive developer in said second chamber; and an opposing portion provided in said second chamber so as to oppose a peripheral surface of the reverse feeding portion at an overlapping position overlapping with the reverse feeding portion with respect to a rotational axis direction of said feeding member, wherein said opposing portion includes a projected portion for forming a predetermined clearance with the reverse feeding portion by being projected from a side surface of said second chamber in a horizontal direction, said projected portion being disposed higher than a rotation center of the reverse feeding portion and lower than a top of the reverse feeding portion as seen in the rotational axis direction of said feeding member and which is more remote from said first chamber than a rotation center of said feeding member.

2. A developing device according to claim 1, wherein said opposing portion is provided upstream of the reverse feeding portion with respect to the rotational axis direction of said feeding member.

3. A developing device according to claim 1, wherein a side where said feeding member is raised with rotation of said feeding member is a side opposite from said first chamber with respect to the rotation center of said feeding member as seen in the rotational axis direction of said feeding member.

4. A developing device according to claim 1, wherein said projected portion is non-magnetic.

5. A developing device according to claim 1, further comprising a second projected portion for forming a predetermined clearance with the reverse feeding portion by being projected from a side surface of said second chamber in a horizontal direction, said second projected portion being disposed in a region which is higher than the rotation center of the reverse feeding portion and lower than a top of the reverse feeding portion as seen in the rotational axis direction of said feeding member and which is closer to said first chamber than the rotation center of said feeding member is.

6. A developing device according to claim 1, wherein said opposing portion includes a first region where a clearance from the reverse feeding portion is a first gap and a second region where the clearance from the reverse feeding portion is a second gap larger than the first gap.

7. A developing device according to claim 1, wherein above the reverse feeding portion, a gap in which a clearance between the reverse feeding portion and said second chamber is larger than a clearance between the reverse feeding portion and said opposing portion is formed, and wherein the excessive developer is dischargeable through the gap.

8. A developing device according to claim 5, wherein a highest point position of said projected portion at an opposing surface to the reverse feeding portion is higher than a highest point position of said second projected portion at an opposing surface to the reverse feeding portion.

9. A developing device according to claim 5, wherein a length of said projected portion with respect to the rotational axis direction of said feeding member is longer than a length of said second projected portion with respect to the rotational axis direction of said feeding member.

10. A developing device according to claim 5, wherein said second projected portion is non-magnetic.

* * * * *